US007392862B2

(12) United States Patent
Zahradnik et al.

(10) Patent No.: US 7,392,862 B2
(45) Date of Patent: Jul. 1, 2008

(54) SEAL INSERT RING FOR ROLLER CONE BITS

(75) Inventors: Anton F. Zahradnik, Sugar Land, TX (US); Don Q. Nguyen, Houston, TX (US); Ronny D. McCormick, Magnolia, TX (US); Terry J. Koltermann, The Woodlands, TX (US); Michael Joseph Veasey, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/499,414

(22) Filed: Aug. 4, 2006

(65) Prior Publication Data

US 2007/0158114 A1 Jul. 12, 2007

Related U.S. Application Data

(60) Provisional application No. 60/756,901, filed on Jan. 6, 2006.

(51) Int. Cl.
*E21B 10/22* (2006.01)

(52) U.S. Cl. ..... 175/371; 277/336

(58) Field of Classification Search ..... 175/371, 175/372; 277/380, 336, 379, 397, 384
See application file for complete search history.

(56) References Cited

U.S. PATENT DOCUMENTS 4,666,001 A * 5/1987 Burr ..... 175/371
4,762,189 A * 8/1988 Tatum ..... 175/371
4,825,964 A * 5/1989 Rives ..... 175/371
4,934,467 A 6/1990 Langford, Jr.
5,005,989 A 4/1991 Karlsson
5,295,549 A * 3/1994 Dolezal et al. ..... 175/371
5,570,750 A 11/1996 Williams
5,875,861 A * 3/1999 Daly et al. ..... 175/371
6,305,483 B1 * 10/2001 Portwood ..... 175/371
6,427,790 B1 * 8/2002 Burr ..... 175/371
6,513,607 B2 * 2/2003 Peterson et al. ..... 175/371

* cited by examiner

*Primary Examiner*—Jennifer H Gay
*Assistant Examiner*—Daniel P Stephenson
(74) *Attorney, Agent, or Firm*—Bracewell & Giuliani LLP

(57) ABSTRACT

An earth boring bit has a bit body with a depending bearing pin. An insert ring is mounted on the bearing pin. The insert ring has an inner diameter greater than an outer diameter of the bearing pin, defining a clearance between the insert ring and the bearing pin to allow the insert ring to float relative to an axis of the bearing pin. An inner seal is in sealing engagement with the bearing pin and the inner diameter of the insert ring. A cone is rotatably mounted on the bearing pin, the cone having a cavity containing an outer seal groove. An outer seal located in the outer seal groove is in dynamic sealing engagement with an outer diameter of the insert ring. An anti-rotation member engages a portion of the insert ring to prevent rotation of the insert ring.

17 Claims, 2 Drawing Sheets

Fig. 2
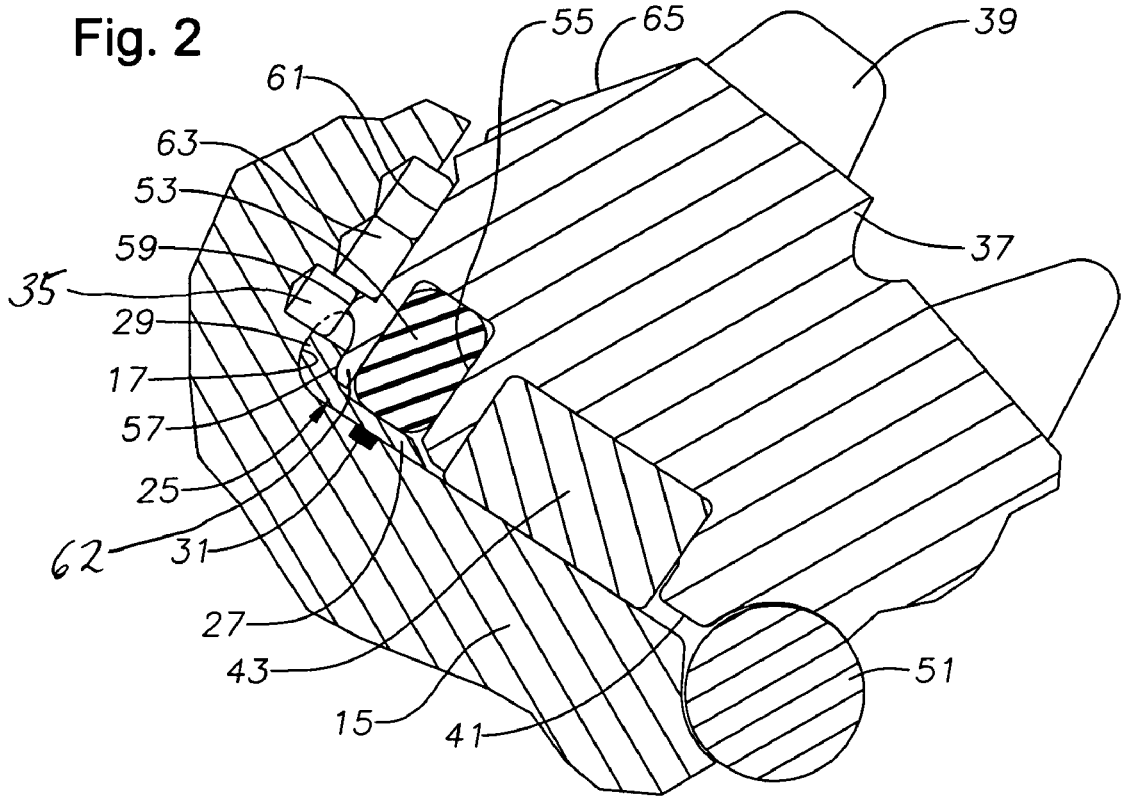
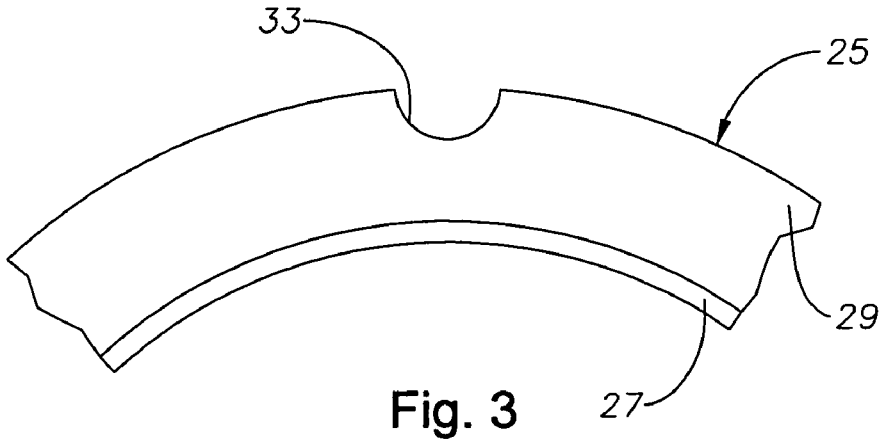
Fig. 3

SEAL INSERT RING FOR ROLLER CONE BITS

CROSS-REFERENCE TO RELATED APPLICATION

This application claims the benefit of U.S. provisional application Ser. No. 60/756,901, filed Jan. 6, 2006.

FIELD OF THE INVENTION

This invention relates in general to rolling cone earth-boring bits, and in particular to an insert ring that is mounted between the bearing pin and the seal for resisting wear and corrosion.

BACKGROUND OF THE INVENTION

A typical roller cone earth-boring bit has a bit body with three bit legs. A bearing pin extends from each bit leg, and a cone rotatably mounts on the bearing pin. The bearing surfaces between the cavity of the cone and the bearing pin are filled with a lubricant. A seal is located between the cone and the bearing pin to seal lubricant within and keep drilling fluid from entry.

Many designs for seals have been proposed and used. One type comprises an elastomeric ring that is located in a groove in the cone near the mouth of the cavity. The ring normally rotates with the cone and seals against the stationary bearing pin. The ring and seal groove are designed to provide a selected contact pressure of the inner diameter of the ring with the bearing pin. A high downward force is imposed on the drill bit during operation, resulting in a higher contact pressure on the lower side of the bearing pin than on the upper side. Also, during operation, there may be slight cone movement relative to the axis of the bearing pin. This movement results in varying contact pressure on both the bearing and seal. Varying contact pressure can cause excessive heat and wear in certain areas of the seal, shortening the life. Also, cuttings from the earth formation are able to contact portions of the seal and tend to cause it to wear.

U.S. Pat. Nos. 5,005,989, 5,570,750, and 4,934,467 disclose installing a rigid insert ring on the bearing pin for engagement by the inner diameter of the seal ring. The insert ring is of harder material than the bearing pin for reducing wear on the seal ring. In the FIG. 7 embodiment of the '989 patent, the insert ring is located on and fixed relative to the bearing pin by a vulcanized layer.

SUMMARY OF THE INVENTION

The earth boring bit of this invention has a rigid insert ring mounted on the bearing pin. The insert ring has an inner diameter greater than an outer diameter of the bearing pin, defining a clearance between the insert ring and the bearing pin to allow the insert ring to float relative to an axis of the bearing pin. An inner seal is in sealing engagement with the bearing pin and the inner diameter of the insert ring. A cone is rotatably mounted on the bearing pin, the cone having a cavity containing an outer seal groove. An outer seal is located in the outer seal groove and in dynamic sealing engagement with an outer diameter of the insert ring. An anti-rotation member mounted to a portion of the bit body is in engagement with a portion of the insert ring to prevent rotation of the insert ring.

Preferably, the insert ring is of uniform thickness around its circumference. In the preferred embodiment, the anti-rotation member is a pin that has an axis normal to the portion of the seal ring that it engages. Also, in the preferred embodiment, the insert ring has a radially extending flange that abuts the bit leg. The flange on the insert ring may be partially recessed within an annular groove formed on the bit leg. Preferably the inner seal is located in a groove formed in the bearing pin.

BRIEF DESCRIPTION OF THE DRAWINGS

FIG. 2 is an enlarged partial view of a portion of the bearing pin and cone as shown in FIG. 1.

FIG. 3 is an elevational view of a portion of the insert ring of the bit of FIG. 1, shown removed from the bit.

DETAILED DESCRIPTION OF THE INVENTION

Figure 1:
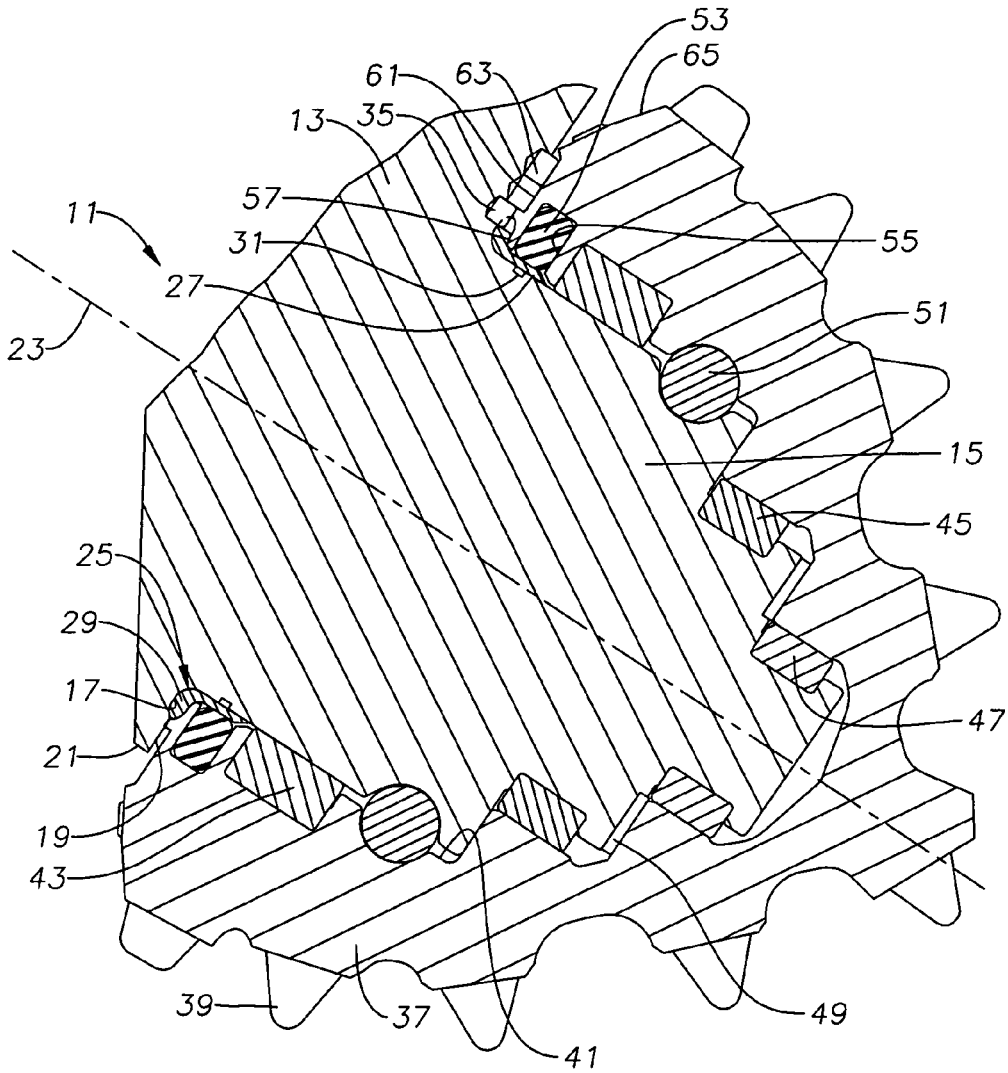
FIG. 1 is a sectional view illustrating a cone and bearing pin of an earth-boring bit constructed in accordance with this invention.

Referring to FIG. 1, bit 11 has a body made up of a plurality of legs 13, although only a portion of one is shown. Typically, bit 11 will have three bit legs 13, each depending from a bit body. A bearing pin 15 comprising a cylindrical member extends downward from bit leg 13 toward an axis of rotation of bit 11.

An annular groove 17 is formed around the junction of bit leg 13 and bearing pin 15. Recess 17 is formed in a portion of bit leg 13 referred to as a last machined surface 19. Last machined surface 19 is a generally flat surface located in a plane perpendicular to the bearing pin axis 23. Last machined surface 19 extends radially outward from annular recess 17. A portion of last machined surface 19 on the lower side of bit leg 13 is referred to as the shirttail 21. Recess 17 has a radial width that is about the same as the radial width of last machined surface 19 at shirttail 21.

A rigid insert ring 25 is installed on bearing pin 15 at the junction with bit leg 13. Insert ring 25 is preferably an L-shaped member in cross-section, having a cylindrical portion 27 that extends around bearing pin 15 and a flange portion 29 that extends radially outward from cylindrical portion 27. Flange portion 29 locates within recess 17 and has a mating contour. In this embodiment, flange portion 29 has a thickness that is about twice the depth of recess 17, so that it protrudes a short distance forward from last machined surface 19. Flange portion 29 in this embodiment is thicker than cylindrical portion 27. Cylindrical portion 27 may taper on its forward end. The thickness of cylindrical portion 27 is preferably uniform around the circumference of ring 25.

The inner diameter of cylindrical portion 27 is slightly greater than the outer diameter of bearing pin 15 by a few thousandths of an inch in the preferred embodiment. Slight, non-rotational movement or floating of insert ring 25 relative to the axis of bearing pin 15 is allowed to occur by the clearance provided between the inner diameter of cylindrical portion 27 and the outer diameter of bearing pin 15. An inner seal 31, which is an elastomeric O-ring in this embodiment, is located in a groove formed in bearing pin 15 and seals against the inner diameter of cylindrical portion 27 of insert ring 25. Inner seal 31 preferably has a uniform cross-sectional thickness around its circumference.

An anti-rotation member prevents insert ring 25 from rotating relative to bearing pin 15. In this embodiment, a recess or slot 33, shown in FIG. 3, is formed at one or more places in the outer periphery of flange portion 29. Slot 33 is semicircular, although it could be different shapes or a complete hole if desired. An anti-rotation pin 35 (FIGS. 1 and 2) engages slot 33 and inserts into last machined surface 19 to prevent rotation of insert ring 25 relative to bearing pin 15.

Referring again to FIG. 1, a cone 37 mounts rotatably to each bearing pin 15. Cone 37 has an exterior containing a plurality of cutting elements 39, which may be teeth machined into the exterior of cone 37. Alternately, cutting elements 39 could be tungsten carbide inserts pressed into mating holes in the exterior of cone 37. Cone 37 has a cone cavity 41 that fits closely over bearing pin 15.

A variety of different bearing arrangements may be utilized between cone 37 and bearing pin 15. In the example shown, a rearward set of cylindrical roller bearings 43 is carried within a groove in cavity 41 for engaging bearing pin 15. This embodiment also discloses an intermediate set of roller bearings 45 engaging a smaller diameter portion of bearing pin 15 and a set of nose roller bearings 47 engaging an even smaller diameter portion of bearing pin 15. A thrust washer 49 is located on a thrust shoulder of bearing pin 15 for engaging a mating surface within cone cavity 41. Cone 37 is retained on bearing pin 15 by a plurality of balls 51 that engage mating recesses in cone cavity 41 and on bearing pin 15.

Cone cavity 41 is filled with a lubricant that is supplied from a lubricant reservoir and pressure compensator (not shown) through passages (not shown) to the spaces between cone 37 and bearing pin 15. A variety of seals may be employed to seal the lubricant within cone cavity 41 and prevent encroachment of drilling bit fluid from the exterior. In this embodiment, the seal comprises an elastomeric seal 53 located within a seal groove 55 formed near the entrance or mouth of cone cavity 41. Referring to FIG. 2, seal groove 55 preferably has parallel side walls, each being in a plane perpendicular to the axis of bearing pin 15. Seal 53, also referred to as "outer" seal 53, has an inner diameter portion that slidingly engages the exterior of insert ring cylindrical portion 27. Seal 53 typically rotates in unison with cone 37, but some rotation or slippage relative to cone 37 may occur. In this embodiment, seal 53 has generally flat forward and rearward sides that are parallel to each other and semi-cylindrical rounded inner and outer diameter portions. In this embodiment, the distance between the inner and the outer diameter portions is considerably greater than the distance between the flat forward and rearward portions, but other shapes are feasible.

Referring still to FIG. 2, cone 37 has a backface that surrounds the mouth of cone cavity 41. The backface includes an inner backface portion 57 that extends from the mouth of cavity 41 radially outward relative to bearing pin axis 23 (FIG. 1). Inner backface portion 57 is not flat; rather, it curves in this embodiment to mate with the contour of insert ring flange 29. Inner backface portion 57 curves around insert ring flange 29 and extends rearward, defining an annular rib 59 located adjacent the outer diameter of insert ring flange 29. A slight clearance will exist between the inner backface portion 57 and insert ring 25. In this embodiment, the cone backface includes an outer portion 61 that is recessed in a forward direction from annular rib 59. Outer backface portion 61 extends radially outward to an intersection with a gage surface 65 of cone 37.

Annular rib 59 extends over a portion of insert ring flange 29 and has a flat face separated from last machined surface 19 by a small clearance. The width of this clearance is less than the thickness of flange 29, thereby restricting the entry of borehole cuttings. Outer seal groove 55 is spaced slightly forward toward the bit axis of rotation from inner backface portion 57. The portion of cone 37 between inner backface portion 57 and groove 55 is a thin flange 62 that separates outer seal 53 from insert ring flange 29. Outer seal 53 thus does not contact insert ring flange 29.

Anti-rotation pin 35 has a flat face that is separate from cone annular rib 59 by a small clearance. In this embodiment, the face of anti-rotation pin 35 is substantially flush with the portion of last machined surface 19 located radially outward from annular groove 17, which receives insert ring flange 29. The hole for receiving anti-rotation pin 35 is partly in groove 17 and partly in last machined surface 19 just outward from groove 17. As a result, a portion of anti-rotation pin 35 protrudes from the base of groove 17.

One or more diverter pins 63 may be mounted in holes in bit leg 13 and protrude forward, each having an axis parallel to bearing pin axis 23 (FIG. 1). The forward ends of diverter pins 63 are flat and closely spaced to cone outer backface portion 61. Diverter pins 63 serve to divert cuttings and drilling fluid from the spaces between the backface of cone 37 and the adjacent surface of bit leg 13. Diverter pins 63 could be eliminated, if desired. Also, outer backface portion 61 could extend in a straight line from annular rib 59 to gage surface 65, rather than being recessed as shown.

In operation, as bit 11 rotates, each cone 37 rotates about bearing pin axis 23. Drilling fluid is pumped down a drill string, which flows out nozzles and back up around the exterior of bit 11 along with cuttings. Seal 53 normally rotates in unison with cone 37 and slidingly engages the outer surface of insert ring cylindrical portion 27. Cone 37 will wobble or move slightly relative to the axis of bearing pin 15 because of the weight imposed on bit 11. Insert ring 25 will tend to move with cone 37, thus will float relative to the axis of bearing pin 15. This floating movement tends to maintain a desired contact pressure of outer seal 53 with floating insert ring 25.

Diverter pins 63, if used, may reduce the amount of cuttings and debris that otherwise would enter the spaces between last machined surface 19 and backface portions 57 and 61. Some cuttings and debris, nevertheless, will come into contact with insert ring 25. Insert ring 25 is preferably formed of a metal that is more resistant to abrasion and corrosion than the material of bit leg 13, bearing pin 15 and cone 37, to inhibit the wear that would normally occur at the intersection between last machined surface 19 and bearing pin 15.

The invention has significant advantages. The insert ring reduces differences in contact pressure applied to the seal. The insert ring also provides protection for the seal against contact with cuttings and debris.

While the invention has been shown in only one of its forms, it should be apparent to those skilled in the art that it is not so limited, but is susceptible to various changes without departing from the scope of the invention.

We claim:

1. An earth boring bit, comprising:

a bit body having a depending bearing pin, defining a base area at the junction of the body and the bearing pin;

a rigid insert ring mounted on the bearing pin, the insert ring having an inner diameter greater than an outer diameter of the bearing pin, defining a clearance between the insert ring and the bearing pin to allow the insert ring to float relative to the bearing pin, the insert ring having a slot in its outer margin;

an inner seal in sealing engagement with the bearing pin and the inner diameter of the insert ring;

a cone rotatably mounted on the bearing pin, the cone having a cavity containing an outer seal groove;

an outer seal in the outer seal groove and in dynamic sealing engagement with an outer diameter of the insert ring; and a pin secured to the body and extending into the slot on the outer margin of the insert ring to prevent rotation of the insert ring, the slot allowing floating movement of the insert ring relative to the pin.

2. The bit according to claim 1, wherein the insert ring is of uniform thickness around its circumference.

3. The bit according to claim 1, wherein the pin protrudes from the base area and has an axis parallel with an axis of the bearing pin.

4. The bit according to claim 1, wherein:

the base area comprises a cylindrical surface on the bearing pin and an adjacent last machined surface on the body;

the insert ring has a radially extending flange that abuts the last machined surface, the slot being located in the flange; and the pin protrudes from the last machined surface.

5. The bit according to claim 1, wherein:

the insert ring has a radially extending flange; and the outer seal groove has parallel side walls, one of the side walls defining an annular rib of the cone located between the flange and the outer seal groove.

6. The bit according to claim 1, wherein the inner seal comprises:

an inner seal groove formed on the bearing pin;

an elastomeric ring in the inner seal groove and in sealing engagement with the inner diameter of the insert ring; and wherein the insert ring is restrained from moving axially parallel with an axis of the bearing pin.

7. An earth boring bit, comprising:

a bit body having a depending bearing pin, defining a base area at the junction of the body and the bearing pin;

a rigid insert ring mounted on the bearing pin, the insert ring having an inner diameter greater than an outer diameter of the bearing pin, defining a clearance between the insert ring and the bearing pin to allow the insert ring to float relative to the bearing pin;

an inner seal in sealing engagement with the bearing pin and the inner diameter of the insert ring;

a cone rotatably mounted on the bearing pin, the cone having a cavity containing an outer seal groove;

an outer seal in the outer seal groove and in dynamic sealing engagement with an outer diameter of the insert ring;

an anti-rotation member to prevent rotation of the insert ring; wherein:

the base area comprises a cylindrical surface on the bearing pin and an adjacent substantially flat surface on the body; wherein the bit further comprises:

an annular groove on the flat surface; and a flange on the insert ring and partially recessed within the annular groove.

8. The bit according to claim 7, wherein:

the cone has an annular backface that encircles a mouth of the cavity, the backface having a protruding annular rib that extends over a portion of an outer diameter of the flange.

9. An earth boring bit, comprising:

a bit body having a bit leg with a depending bearing pin, defining a base area at the junction of the bit leg and the bearing pin;

a rigid insert ring mounted on the bearing pin, the insert ring having an inner diameter greater than an outer diameter of the bearing pin, defining a clearance between the insert ring and the bearing pin to allow the insert ring to float relative to the bearing pin;

an inner seal groove formed on the bearing pin;

an elastomeric inner seal ring in the inner seal groove and in sealing engagement with the inner diameter of the insert ring;

a cone having a cavity rotatably mounted on the bearing pin;

an outer seal in the cavity in sealing engagement with the cone and with an outer diameter of the insert ring;

a pin-like member mounted to the base area and protruding into engagement with a portion of the insert ring to prevent rotation of the insert ring but allow the insert ring to float relative to the pin-like member; and the cone having a portion that engages the insert ring to prevent the insert ring from moving axially parallel with an axis of the bearing pin.

10. The bit according to claim 9, wherein the insert ring and the inner seal are of uniform thickness around their circumferences.

11. The bit according to claim 9, wherein:

the base area comprises a cylindrical surface on the bearing pin and an adjacent last machined surface on the body;

the insert ring has a radially extending flange that abuts the last machined surface; and the pin-like member protrudes from the last machined surface into engagement with a recess in the flange of the insert ring.

12. The bit according to claim 9, wherein the outer seal comprises:

an outer seal groove formed in the cavity; and an elastomeric outer seal ring located within the outer seal groove.

13. The bit according to claim 12, wherein:

the insert ring has a radially extending flange; and the outer seal groove has two parallel side walls, defining an annular rib of the cone located between the flange and the outer seal ring.

14. An earth boring bit, comprising:

a bit body having a bit leg with a depending bearing pin, defining a base area at the junction of the bit leg and the bearing pin;

a rigid insert ring mounted on the bearing pin, the insert ring having an inner diameter greater than an outer diameter of the bearing pin, defining a clearance between the insert ring and the bearing pin to allow the insert ring to float relative to the bearing pin;

an inner seal groove formed on the bearing pin;

an elastomeric inner seal ring in the inner seal groove and in sealing engagement with the inner diameter of the insert ring;

a cone having a cavity rotatably mounted on the bearing pin;

an outer seal in the cavity in sealing engagement with the cone and with an outer diameter of the insert ring;

a pin-like member mounted to the base area and protruding into engagement with a portion of the insert ring to prevent rotation of the insert ring; wherein:

the base area comprises a cylindrical surface on the bearing pin and an adjacent substantially flat surface on the body; wherein the bit further comprises:

an annular groove on the flat surface; and a flange on the insert ring that is partially recessed within the annular groove.

15. The bit according to claim 14, wherein:

the cone has an annular backface that encircles a mouth of the cavity, the backface having a protruding annular rib that extends over a portion of an outer diameter of the flange.

16. An earth boring bit, comprising:

a bit body having a bit leg with a depending bearing pin;

a rigid insert ring having a flange portion that abuts a portion of the bit leg and a cylindrical portion that has an inner diameter greater than an outer diameter of the bearing pin, defining a clearance between the cylindrical portion of the insert ring and the bearing pin to allow the insert ring to float relative to the bearing pin;

an inner seal groove formed on the bearing pin;

an elastomeric inner seal ring in the inner seal groove and in sealing engagement with the cylindrical portion of the insert ring;

a cone having a cavity rotatably mounted on the bearing pin;

an outer seal groove formed in the cavity and having parallel side walls;

an elastomeric outer seal ring in sealing engagement with the outer seal groove and with the cylindrical portion of the insert ring, one of the side walls of the outer seal groove separating the outer seal ring from the flange of the insert pin; and wherein:

the flange portion of the insert ring is partially recessed within an annular groove formed on the bit leg.

17. The bit according to claim 16, wherein the cone has a backface that encircles a mouth of the cavity, the backface having an annular rib that extends partially over an outer diameter of the flange portion of the insert ring.

* * * * *